US005653358A

United States Patent [19]

Sneddon

[11] Patent Number: 5,653,358

[45] Date of Patent: Aug. 5, 1997

[54] MULTILAYER COMPOSITE PRESSURE VESSEL WITH A FITTING INCORPORATED IN A STEM PORTION THEREOF

[75] Inventor: Kirk Sneddon, Sayville, N.Y.

[73] Assignee: Arde, Inc., Brooklyn, N.Y.

[21] Appl. No.: 564,896

[22] Filed: Nov. 29, 1995

Related U.S. Application Data

[63] Continuation of Ser. No. 225,236, Apr. 8, 1994, abandoned.

[51] Int. Cl.[6] ..... B65D 25/14

[52] U.S. Cl. ..... 220/465; 220/455; 220/457; 220/590

[58] Field of Search ..... 220/465, 454, 220/455, 457, 450, 444, 414, 586, 588, 589, 590, 591, 592, 581, 565, 466, 601, 643, 644

[56] References Cited

U.S. PATENT DOCUMENTS

| | | | |
|---|---|---|---|
| 2,346,423 | 4/1944 | Gray . | |
| 2,744,043 | 5/1956 | Ramberg | 220/414 |
| 2,827,195 | 3/1958 | Kerns . | |
| 3,358,867 | 12/1967 | Skinner | 220/414 |
| 3,874,544 | 4/1975 | Harmon | 220/414 |
| 3,907,149 | 9/1975 | Harmon | 220/590 |
| 3,908,851 | 9/1975 | Jacobs | 220/414 |
| 4,369,894 | 1/1983 | Grover et al. | 220/414 |
| 4,685,589 | 8/1987 | Benton | 220/414 |
| 4,690,295 | 9/1987 | Wills | 220/590 |
| 4,905,856 | 3/1990 | Krogager . | |
| 4,925,044 | 5/1990 | Hembert | 220/589 |
| 5,287,987 | 2/1994 | Gaiser | 220/589 |
| 5,287,988 | 2/1994 | Murray | 220/590 |
| 5,494,188 | 2/1996 | Sirosh | 220/590 |

FOREIGN PATENT DOCUMENTS

| | | | |
|---|---|---|---|
| 6616351 | 7/1967 | Netherlands | 220/586 |

*Primary Examiner*—Stephen J. Castellano
*Attorney, Agent, or Firm*—Cohen, Pontani, Lieberman, Pavane

[57] ABSTRACT

A pressure vessel includes a main portion bounding an internal chamber for accommodating a pressurized fluid medium, and a hollow stem portion projecting from the main portion and bounding a passage communicating with the internal chamber. The vessel walls are formed by an inner liner that extends into the stem portion, and a fiber reinforced outer jacket overwrapping a main portion of the liner to confer structural strength to the main portion of the vessel. A fitting axially adjoins the stem portion and is secured thereto by a strengthening body that is situated externally of and engages the stem portion of the liner and an axial portion of the fitting, and the strengthening body being anchored to the outer jacket. The axial portion of the fitting has an external projection or ring that is firmly engaged by the strengthening body to prevent at least axial movement of the fitting relative to the stem portion of the liner. The strengthening body may either be a fiber reinforced body wrapped around the stem portion of the liner and the axial portion of the fitting, or the combination of a split sleeve having an integral anchoring portion anchored between successive layers of the outer jacket and a main portion surrounding the stem portion of the liner and the axial portion of the fitting, and a tightenable ring that surrounds and engages the main portion of the split sleeve.

11 Claims, 5 Drawing Sheets

MULTILAYER COMPOSITE PRESSURE VESSEL WITH A FITTING INCORPORATED IN A STEM PORTION THEREOF

This is a continuation of application Ser. No. 08/225,236, filed Apr. 8, 1994 now abandoned.

FIELD OF THE INVENTION

The present invention relates to containers in general, and more particularly to containers capable of accommodating various media at relatively high pressures.

BACKGROUND OF THE INVENTION

In many technical fields, a need exists for storing various liquid or gaseous media, such as compressed or liquefied gases, for extended periods of time and frequently at very high pressures. Many attempts have already been made in the past to satisfy this need by developing light weight pressurized medium containers or pressure vessels that would accommodate the pressurized medium without suffering leakage losses or structural damage.

For a variety of reasons, not the least important of which is the relatively high ratio of pressure that the vessel walls are able to withstand to the weight of a vessel of a given capacity, it has been found advantageous to give such walls a multilayer or composite structure, including an inner liner and an outer shell surrounding the liner and in intimate contact therewith. The liner is formed of a material, usually a metallic material, that is compatible with (i.e. inert with respect to) and also completely or at least highly impermeable to the medium being stored.

All-metallic pressure vessels have been disclosed, for example, in U.S. Pat. Nos. 2,127,712, 2,661,113, 3,140,006, and 4,964,524, of which all but the second one are directed to vessels of multilayer construction. In this instance, one of the purposes of the liner is to form an inert protective barrier preventing the medium from reaching through gross leakage or permeation through the liner to the outer shell and possibly damaging the shell. However, due to their considerable thickness and intimate contact or engagement with the shell, the liners of all-metallic pressure vessels generally contribute significantly to the load bearing capacity of the vessel. In classical state of the art vessel fabrication, the liner represents a significant fraction of the total weight. Experience with such and similar all-metallic pressure vessel constructions has shown, on the other hand, that they are limited in applicability because they are either too heavy (a criterion that is of paramount importance for applications where weight is at a premium, such as in outer space applications), or expensive to manufacture, or prone to failure, especially due to metallic material fatigue at weakened or stress concentration regions after having been subjected to a number of pressurization and depressurization cycles.

With the advent and development of high strength filaments such as glass, graphite, and synthetic plastic material fibers, and of materials, such as epoxy resins, capable of forming a matrix embedding such filaments and bonding them together into a composite structure, attempts have been made, some more successful than others, to use such composite materials for the outer shell of the pressure vessel. Of course, due to the high strength-to-weight ratio of such materials, the overall weight of the resulting vessel is significantly reduced relative to that of a comparable all-metallic vessel of the same capacity and pressure rating. Examples of vessels of this kind are disclosed, for example, in U.S. Pat. Nos. 2,744,043, 2,827,195, 3,943,010, 3,969,812, and 4,040,163.

For obvious reasons, a pressure vessel of any kind has to have at least one passage for establishing communication between the interior and exterior of the vessel. Inasmuch as the passage is usually to be connected to a conduit, such as a part of the piping of a spacecraft or the like, it is customary to provide the vessel with at least one stem or neck region that protrudes from the main body of the vessel and that is hollow so as to define the passage. This stem region is then equipped with means of one sort or another for attaching the conduit thereto. It will be appreciated that the stem region and the transition between the same and the main body of the vessel constitute a particularly vulnerable area of the pressure vessel, especially because the stem region introduces pertebrations in the relatively uniform global stress field and must be sufficiently thick as considered in the radial direction to permit attachment of the conduit thereto, whereas the liner need not be so dimensioned. At least partly for this reason, the aforementioned attaching means is sometimes provided on a separate fitting member that is mounted on the remainder of the pressure vessel so as to form at least a part of the stem region.

As should be apparent, it is important to assure that such a separate fitting member does not become dissociated from the remainder of the pressure vessel either under normal operating conditions that may involve a number of pressurization and depressurization cycles and/or conduit attachment and detachment operations, or even if the vessel is subjected to rough handling or abuse, such as during transport or other handling of the pressure vessel. This is not an easy task, particularly when the separate fitting member is to be used in a multilayer or composite pressure vessel construction, especially one using a relatively thin liner. To deal with this problem, it is currently customary to equip the separate fitting member with an enlarged portion or flange that is received in the interior of the main portion of the pressure vessel and has a contact surface of a configuration substantially corresponding to that of an associated surface of the main portion of the vessel, to brace itself against such associated surface and to thus maintain the fitting in place relative to the main portion. This enlarged portion is often secured to the lining at least along its periphery, such as by welding, to further improve the connection of the separate fitting to the main portion of the vessel and/or further enhance the impermeability of the interface between the fitting and the remainder of the pressure vessel.

While this solution may be acceptable or even advantageous in some applications, it has been realized that it is fraught with certain problems that make it less than a suitable candidate for more sensitive uses, such as those encountered in space travel or the like. For one, the region of the peripheral connection of the enlarged portion of the fitting to the liner in the main portion of the vessel constitutes a stress concentration area as the internal or external pressure to which the vessel is subjected and/or the temperature of the vessel wall changes, especially when the material of the fitting is different from that or those of the pressure vessel lining and/or shell, as is often the case. This is so because the enlarged portion of the fitting, on the one hand, and the corresponding region of the main portion of the pressure vessel, on the other hand, suffer different deformations due to such pressure or temperature changes. It is further compounded by the fact that the aforementioned corresponding region of the main portion of the vessel is shielded by the enlarged portion of the fitting from the pressure (and the temperature) existing in the interior of the vessel, so that it may undergo different deformation than if it were exposed to such condition(s). Either one of these factors may result in a rapid failure of the joint or seam and in attendant leakage therethrough.

This particular problem does not exist when the pressure vessel is constructed in accordance with the teachings of U.S. Pat. No. 4,905,856 wherein the liner extends all the way into the respective stem portion and the fitting is arranged around this projecting portion of the liner. In accordance with the disclosure of that patent, the fitting is held in position relative to the projecting portion of the liner, and thus to the remainder of the pressure vessel, by the very same filaments as those that form the shell of the pressure vessel, in that portions of such filaments are received in correspondingly configured outer peripheral recesses of the fitting and engage the respective projections that delimit such recesses. A perceived problem of this particular construction is that, as the filaments are stressed owing to the pressurized condition of the contents of the vessel, or as they undergo length changes during pressurization and depressurization of the vessel interior and its contents, they may and usually will undergo plastic deformation or creep thus compromising the original tautness of such filaments and, correspondingly, thus the quality of their engagement with the fitting, until the fitting is no longer firmly held in its desired position and the pressurized vessel is thereby rendered useless.

OBJECT OF THE INVENTION

It is accordingly an object of the present invention to avoid the disadvantages of the prior art.

More particularly, it is an object of the present invention to provide a pressurized vessel constituted by a composite of an impermeable, relatively thin inner liner and a fiber reinforced outer shell, and equipped with at least one separate fitting, which vessel exhibits improved durability relative to comparable prior art vessels.

Still another object of the present invention is to construct a vessel of the type here under consideration, and particularly the means for securing the fitting to the vessel proper, so as to obtain a connection that is not adversely affected either by the passage of time or by conditions encountered during use of the vessel.

A concomitant object of the invention is to provide a vessel of this type that is relatively simple in construction, inexpensive to manufacture, easy to use, and reliable in operation.

SUMMARY OF THE INVENTION

In keeping with these objects and others that will become apparent as this description progresses, the present invention is directed to a pressure vessel of the type including a main portion and at least one hollow stem region projecting from the main portion along an axis and bounding a connecting passage communicating with the interior of the main portion. One of the component parts of such a vessel is a liner bounding the interior of the main portion of the vessel and integrally extending into the hollow stem region where it forms a stem portion that circumferentially bounds an axially limited part of the connecting passage. There is further provided a filament overwrap for overwrapping the liner and for providing structural integrity thereto. A fitting member separate from the stem portion of the liner is located axially adjacent the stem portion to axially complete the connecting passage. According to the invention, there is further provided a securing means situated externally of the stem portion of the liner and of the fitting member. Such securing means is anchored to the main portion of the pressure vessel at the outside of the liner for securing the fitting member to the remainder of the vessel.

A particular advantage of the present invention as thus far described is that, by virtue of the remoteness of the securing means from the filament overwrap, which envelopes the main portion of the pressure vessel, any changes in the length or position of the filaments or fibers of the overwrap in the highly stressed regions of the vessel will have no bearing on the tightness of the grip of the securing means on the fitting.

In accordance with an advantageous aspect of the invention, the securing means includes a body of impregnated filament strengthening material wrapped about the stem portion and at least an axial portion of the fitting member. This body then performs the dual function of stiffening the stem portion in both the circumferential and longitudinal directions and of securing the fitting member to the stem portion. Under these circumstances, it is most advantageous when the filament overwrap covers at least an axial portion of the body for anchoring the body to the main portion of the vessel.

It is further advantageous to provide, in accordance with the invention, the fitting member with at least one restraining projection rigid with its aforementioned axial portion and extending substantially radially outwardly from such axial portion into the body of impregnated strengthening material for restraining, by shear engagement, the fitting member against atleast axial movement relative to the stem portion of the liner. It is particularly advantageous in this respect when the restraining projection is configured as an annular circumferential ring on the outside of the axial portion of the fitting member.

According to another facet of the invention, the securing means includes a split restraining sleeve including a main region surrounding the stem portion of the liner and also at least an axial portion of the fitting member, and an anchoring region rigid with the main region and flaring outwardly in direction axially away therefrom and toward the main portion of the vessel. The anchoring region is surrounded by at least a part of the filament overwrap to anchor the split restraining sleeve in the main portion of the vessel. The main portion has an internal recess that opens onto the axial portion of the fitting member which, in turn, has at least one restraining projection rigid therewith and extending substantially radially outwardly therefrom into the recess to be substantially fittingly received therein. The securing means then further includes a tightenable ring surrounding the main region of the split restraining sleeve, and means for tightening the tightenable ring to cause the split restraining sleeve to firmly engage the projection and to thus restrain the fitting member against at least axial movement relative to the stem portion of the liner. Here again, it is advantageous to configure the restraining projection as an annular circumferential ring extending outwardly from the axial portion of the fitting member, and to configure the recess of the main portion of the split sleeve correspondingly as a circumferentially extending groove.

The liner is advantageously formed as a deposited film liner, particularly of a impermeable metallic material, especially copper.

The novel features that are considered as characteristic of the invention are more particularly set forth in the appended claims. The improved pressure vessel itself, however, both as to its construction and the manner in which it is made, together with additional features and advantages thereof, will be best understood upon perusal of the following detailed description of certain specific embodiments with reference to the accompanying drawings.

BRIEF DESCRIPTION OF THE DRAWING

In the drawings, wherein similar reference characters denote like elements throughout the several views.

DETAILED DESCRIPTION OF THE PREFERRED EMBODIMENTS

Figure 1:
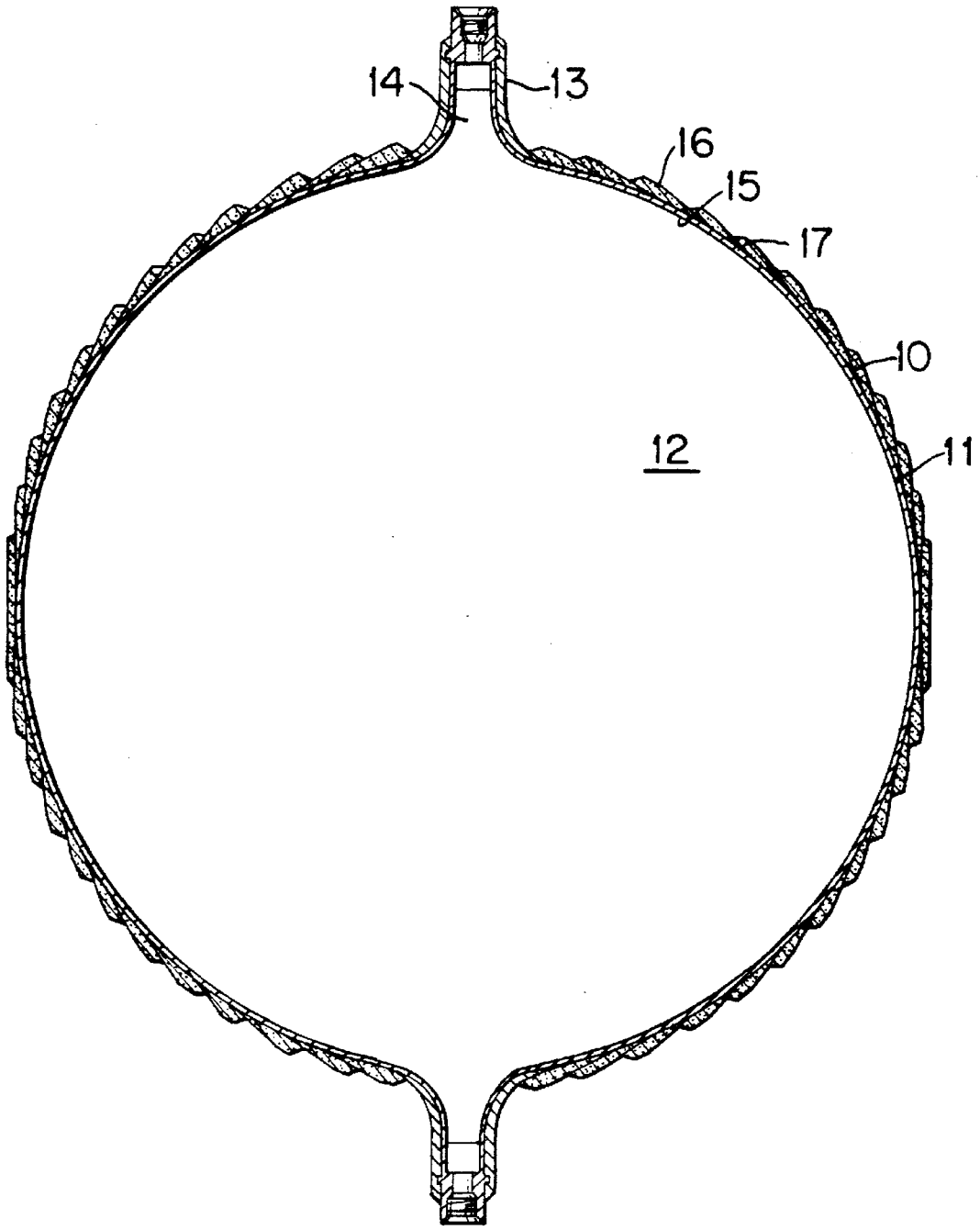
FIG. 1 is an axial sectional view taken through a pressure vessel constructed in accordance with one aspect of the present invention.
Figure 2:
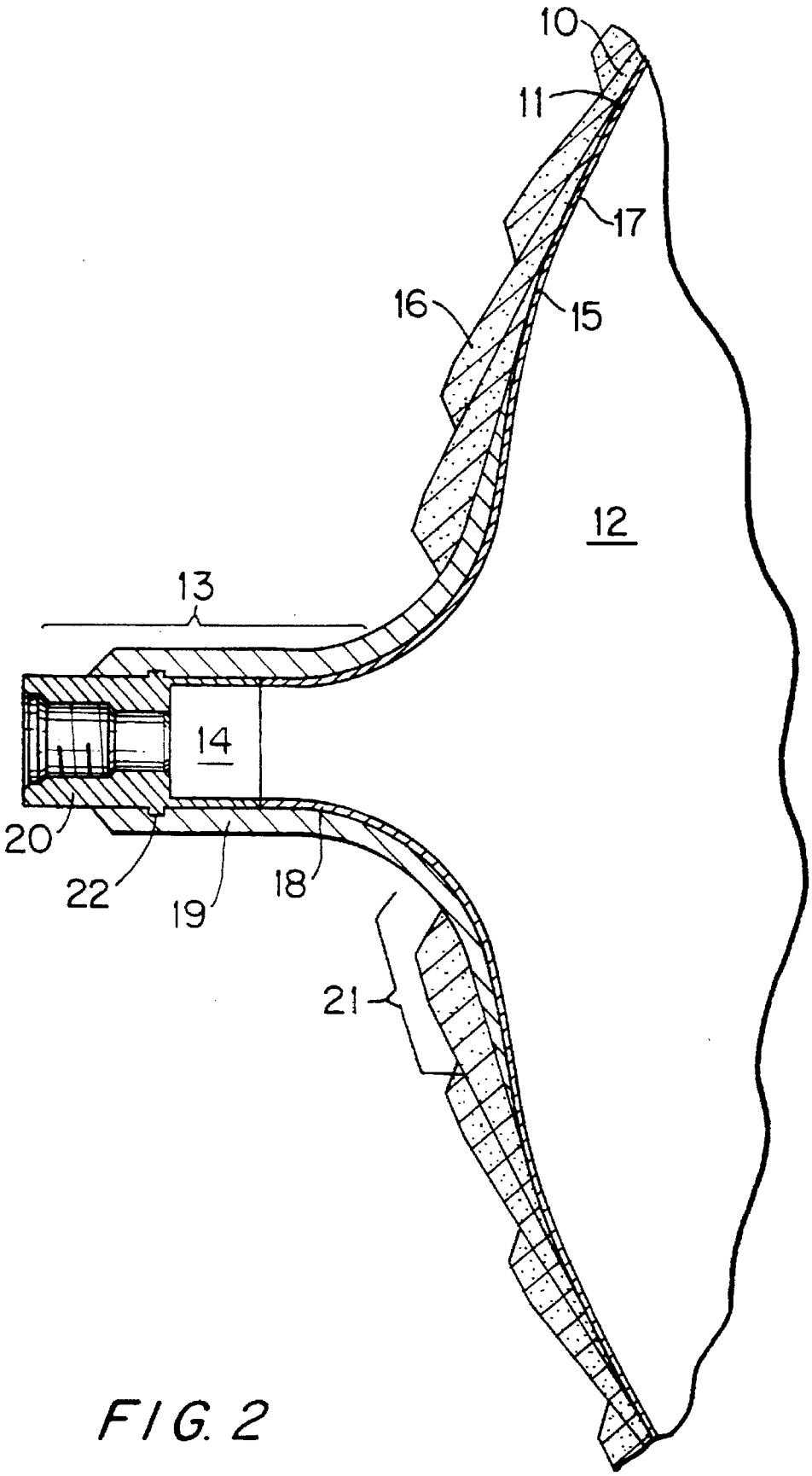
FIG. 2 is an axial sectional view taken through a portion of a pressure vessel constructed in accordance with one aspect of the present invention.

Referring now to the drawings, and initially to FIG. 1 thereof, it may be seen that the general reference numeral 10 identifies a pressure vessel embodying the present invention. FIG. 2 illustrates only that portion of the vessel 10 that contains the region of interest as actually depicted. The pressure vessel has a main portion 11 that bounds an internal chamber or interior 12 of the vessel 10, and a stem or neck portion 13 that projects out of the main portion 11 along an axis and is hollow to define a passage 14 for establishing communication between the interior 12 of the vessel 10 and its exterior.

As illustrated, the vessel 10 is of a multilayer or composite structure in that it includes an inner liner 15 and an outer jacket or overwrap 16 that surrounds the liner 15 and, more particularly, at least a main portion 17 of the liner that bounds the interior 12. The liner used in the vessel 10 of the present invention is preferably very thin—that is, its thickness is chosen to be just above the minimum needed to prevent penetration of the medium contained in the interior 12 through the liner 15 at the highest pressure differential expected to be encountered between the interior 12 of the vessel 10 and its exterior during the lifetime of the vessel 10, and at a level needed to prevent tearing of or other physical damage to the liner 15 when exposed to the highest anticipated or intended internal pressure. It is contemplated that the liner 15 may be formed of a thin film of, e.g., copper deposited on a mandrel comprising a dissolvable material whereby the mandrel is removable from the interior of the vessel after manufacture is completed. On the other hand, the thickness of the liner 15 will generally be insufficient to enable the liner 15 to withstand the expected internal pressures on its own or, as a matter of fact, even to make more than a rather insignificant (less than 5%) contribution to the overall strength of the vessel 10. This, of course, means that the brunt of the stresses resulting from the aforementioned pressure differential are generally intended to be borne by the outer jacket 16.

To that end, the outer jacket 16 is constructed, in a known manner, by superimposed and overlapping layers of impregnated filamentary material that contains glass, graphite or Kevlar™ (a trademark of the E. I. DuPont de Nemours Corp.) fibers wrapped in different directions around the main portion 17 of the liner 15 (while the latter is still supported from the inside by the mandrel onto which it has been deposited), with the interstices between the fibers or filaments being filled by impregnating material such as hardenable epoxy resin that, upon setting or hardening, forms a matrix that firmly embeds such fibers or filamentary material. Thus, after hardening, the filamentary and impregnating material together form a composite, fiber reinforced solid body that is capable of withstanding most if not all of the forces applied to the vessel 10 during its lifetime. Of course, the aforementioned mandrel is removed from the interior 12 of the vessel 10 following the formation of the jacket 16 as, for example, by being dissolved, etched away or melted out, in any well-known or otherwise appropriate manner for removing the particular kind of mandrel used.

As previously mentioned, the passage 14 provided in the stem portion 13 of the vessel is typically intended for connection to a conduit or the like for conducting the medium of interest into or out of the interior 12 of the vessel 10. For this purpose, the stem portion 13 may be provided or associated with a fitting member 20 for implementing such a connection, in a manner that is well known and conventional, as for example through an external or internal thread onto or into which a complementary thread of a connector associated with the conduit may be threaded to establish such connection. In order to permit or facilitate the establishment of a connection, the fitting member 20 must generally have a radial thickness exceeding the thickness of the liner 15 and, in many instances, the fitting member 20 is fabricated of a material different from that of the liner 15. Of course, despite such differences, a durable and impermeable connection must be established between the fitting member 20 and the liner 15.

In accordance with the present invention, this task is accomplished by providing the liner 15 with a hollow extension or stem region 18 integral with the main portion 17 of the liner 15 and extending into the stem portion 13 of the vessel 10 to bound an axial part of the passage 14, the remainder of which is bounded by the fitting member 20. While the liner 15 is advantageously of copper, the fitting member 20 may and often does consist of a different, usually metallic, material, such as stainless steel or titanium. As shown, the fitting member 20 and the stem portion of the stem region 18 of the liner 15 are provided with compatible or complementary bevels forming a plateable or fixable high pressure-tight interface therebetween in the finished condition of the pressure vessel 10.

It will be appreciated that, like the main portion 17 of the liner 15, the stem region 18 is similarly incapable of withstanding the typical pressure differential between the passage 14 and the exterior of the vessel 10. Therefore, in accordance with the present invention, a strengthening material sleeve 19 is formed around the stem region 18 of the liner 15 to confer additional strength to the corresponding section of the stem portion 13 of the vessel, both in the hoop (circumferential) and longitudinal (axial) directions. In addition, the body 19 extends axially beyond the stem region 18 to surround an axial portion of the fitting member 20 and to thus connect the latter with the remainder of the pressure vessel 10.

The strengthening body 19 is formed, in accordance with an advantageous aspect of the present invention, by impregnated filaments wrapped about the stem region 18 of the liner 15 as well as the aforementioned axial portion of the fitting member 20. Thus, upon hardening, the strengthening body 19 comprises a composite of strengthening fibers embedded in a solid matrix of the impregnating material.

As is also shown in FIG. 2 of the drawings, the strengthening body 19 has a portion 21 that extends beyond the stem region 18 of the liner 15 proper and onto the main portion 17 thereof. This portion 21 is overwrapped by the overwrap 16 of the main portion 11 of the vessel 10, and is thus anchored to the main portion 11. In this manner, the strengthening body 19 is prevented from conducting or undergoing axial movement relative to the neck region 18 of the liner 15.

It may also be seen in FIG. 2 that the aforementioned axial portion of the fitting member 20 is provided on its exterior with at least one projection 22 rigid with the fitting member and extending into the strengthening body 19. The projection is preferably configured as a circumferentially complete annulus integral with the remainder of the fitting member 20. The presence of the projection 22 fixes the position of the fitting member 20 relative to the strengthening body 19 such that the fiber-reinforced material of the strengthening body 19 surrounds and engages the projection 22 on all exposed surfaces.

Figure 3:
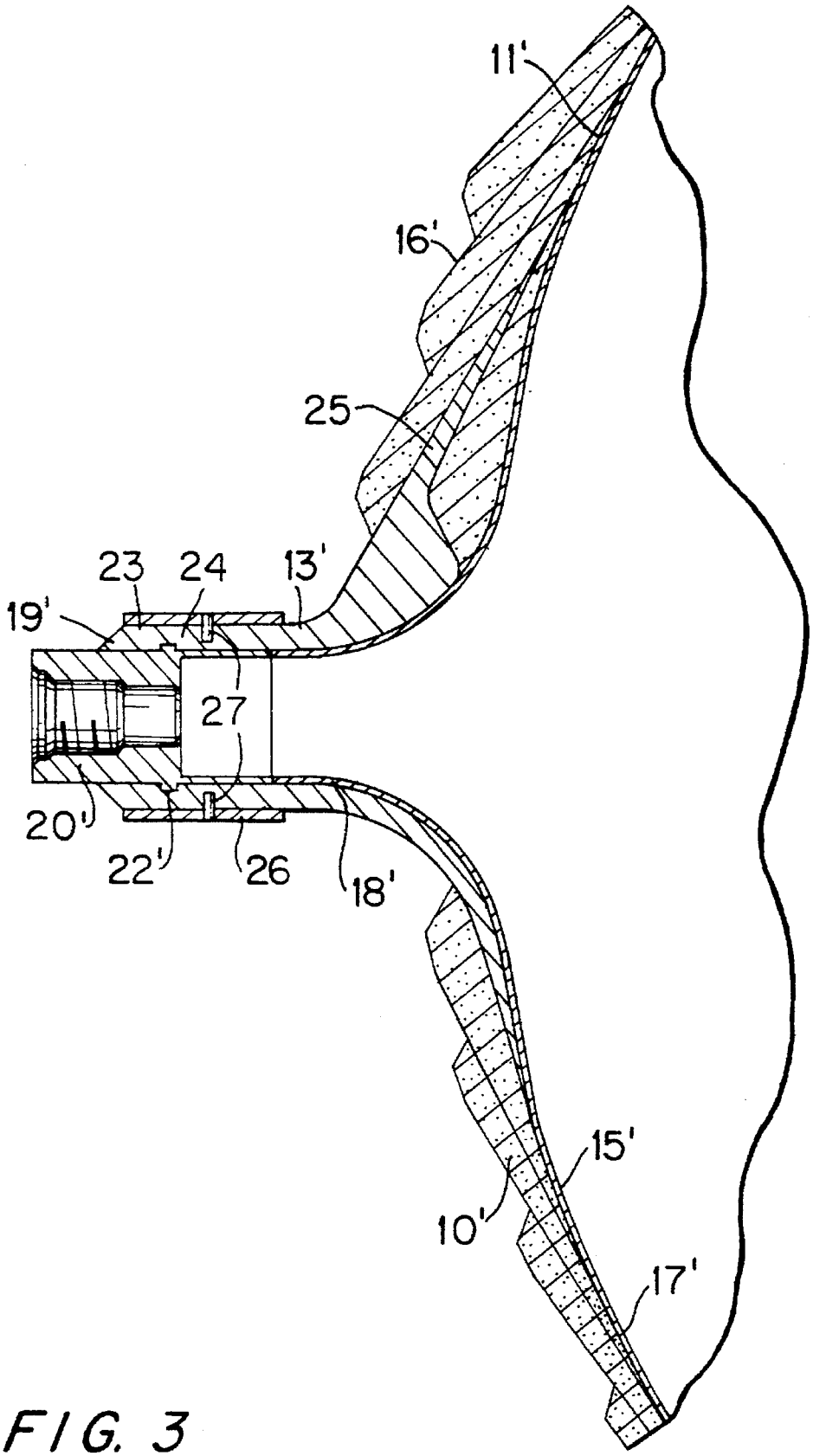
FIG. 3 is a view similar to that of FIG. 2 but showing a modification of the arrangement for connecting the fitting to the remainder of the vessel in accordance with the invention.

FIG. 3 illustrates a modification of the pressure vessel construction that is similar to that described above in so many respects that the same reference numerals as before merely supplemented with primes can and will be used herein to identify corresponding parts and such corresponding parts need not and will not be described in detail unless necessary. Here again, the vessel 10' includes a liner 15' having a main portion 17' and an extension or stem region 18' extending into the neck portion 13' of the vessel 10', and an overwrap 16' surrounding the main portion 17' of the liner 15'. In this modified embodiment, however, the strengthening body 19', rather than being implemented by a fiber reinforced wound body, includes a split (e.g. two-part) sleeve 23 as its main component. The sleeve 23 includes a main portion 24 that surrounds the stem region 18' of the liner 15' and at least an axial portion of a fitting member 20', and an anchoring portion 25 that flares axially outward from the main portion 24 and toward the main portion 11' of the pressure vessel 10'. As so illustrated, the anchoring portion 25 is situated externally of the liner 15'. Moreover, it extends and is thus anchored between successive layers of the overwrap or jacket 16', thereby positionally fixing the split sleeve 23 relative to the main portion 11' of the vessel 10'.

The fitting 20' is provided, in a manner similar or identical to that discussed above, with a (typically ring shaped) projection 22', while the main portion 24 of the split sleeve 23 is formed on its interior with a corresponding recess (or annular groove) that fittingly receives the projection (or ring) 22', thus holding the fitting against at least axial movement with respect to the stem region 18' of the liner 15'. Furthermore, the strengthening body 19' includes a tightening ring 26 that is shown to be threaded on an external thread of the main portion 23 of the split sleeve 23 and secured in position after tightening by shear pins 27. The external thread of the main portion is tapered, that is, it and/or the region of the main portion 24 of the sleeve 23 provided with it diverges slightly in direction toward the anchoring portion, so that the turning of the tightening ring 26 in a tightening sense causes contraction of (i.e. size reduction of any axial gap(s) present in) the split sleeve 23, thus forcing such sleeve 23 closer to the fitting 20' and to positive engagement therewith.

Figure 4:
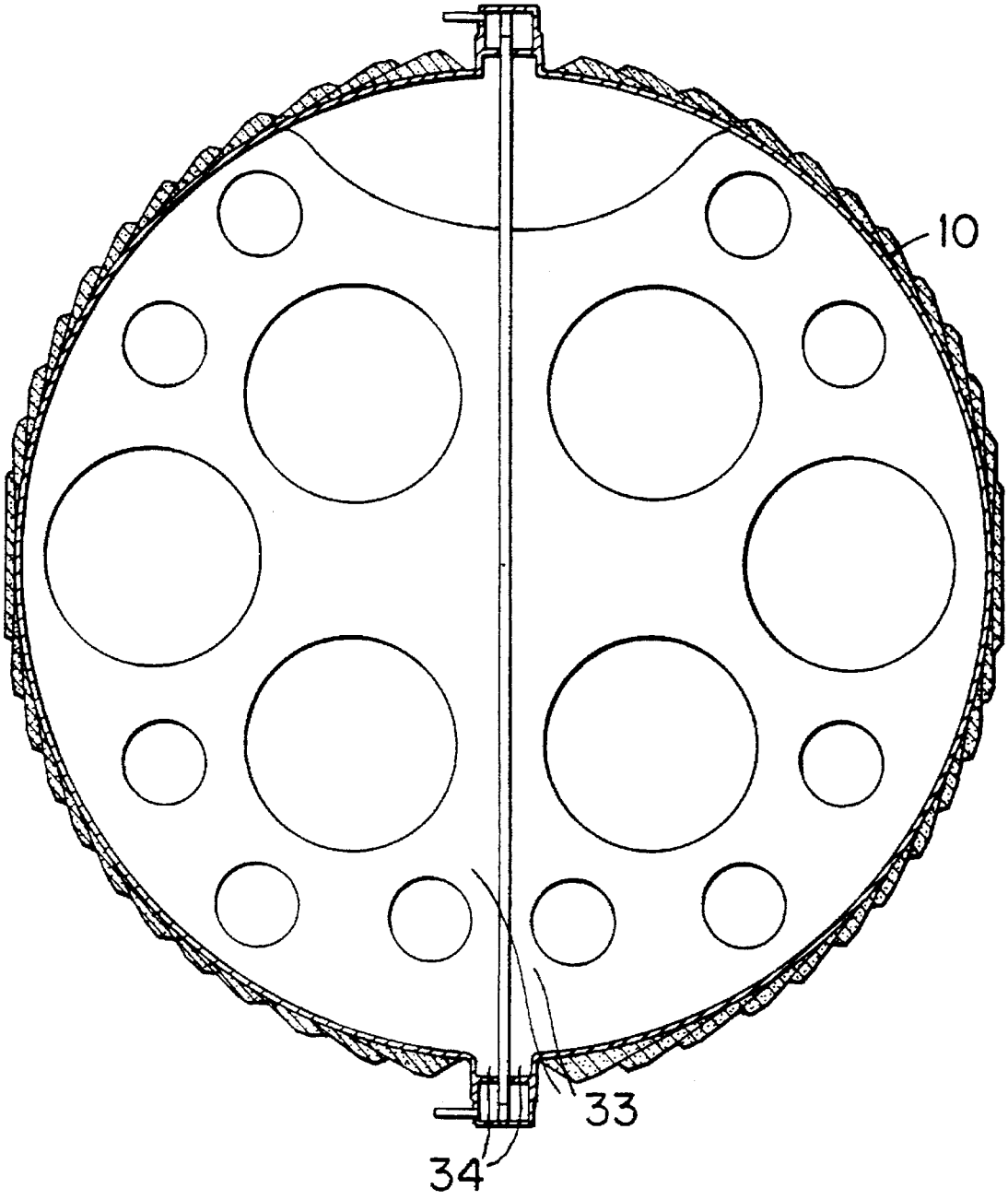
FIG. 4 is an axial sectional view taken through the pressure vessel showing a vane partition.

FIG. 4 of the drawing, in which the same reference numerals as used in conjunction with FIG. 1 are employed to identify corresponding or identical parts, depicts another construction of the pressure vessel 10 of the present invention that is modified for use at the bottom part of the vessel 10. In this case and referencing FIG. 5, an end cap 30 is either integral with or, as shown, secured to the fitting 20, such as by a weldment, to delimit a sump 31. A pipe or outlet tube 32 secured to the cap 30 communicates with the sump 31 to permit removal of liquids in zero gravity by surface tensive forces.

Figure 5:
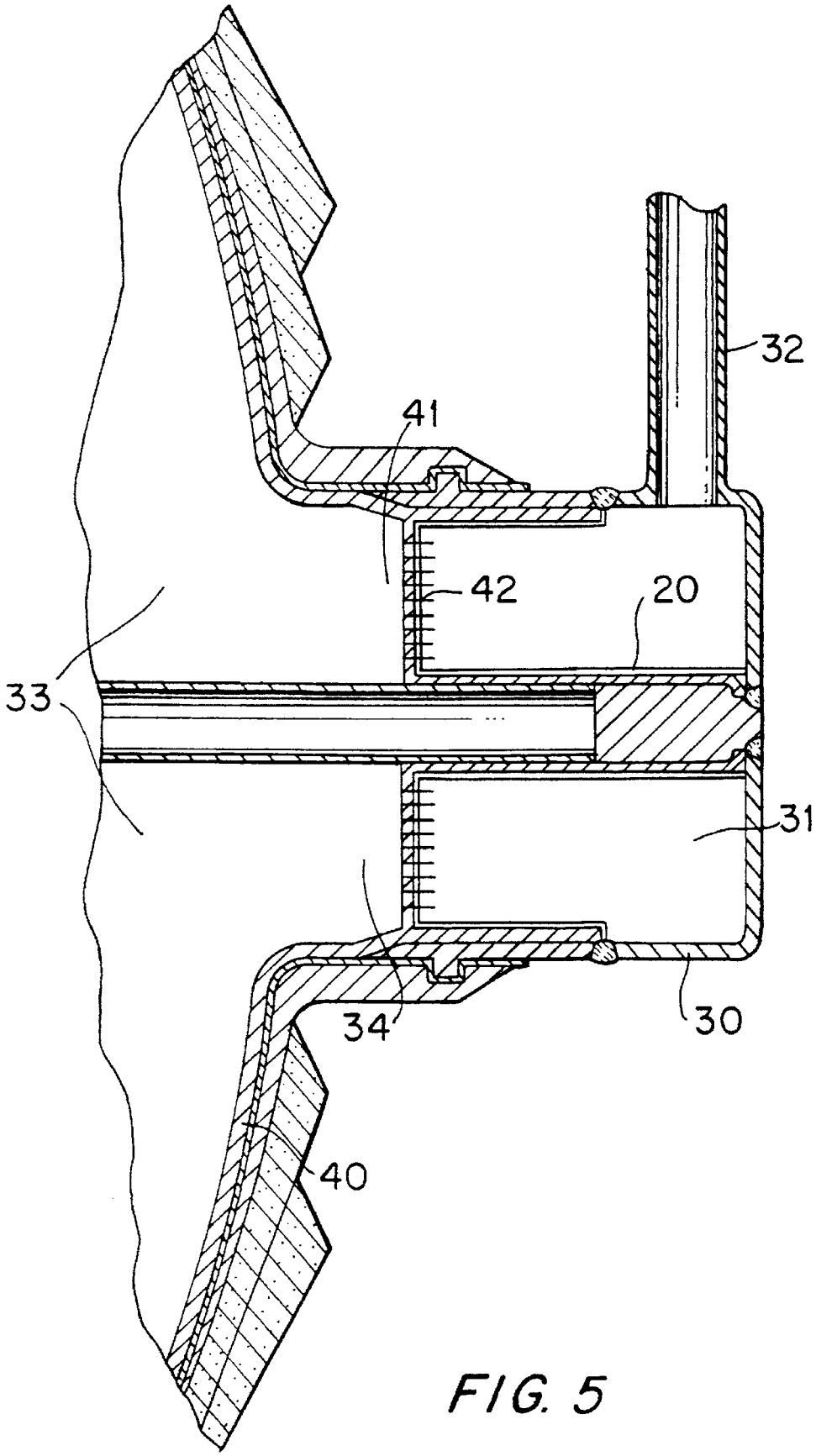
FIG. 5 is another view similar to that of FIG. 2 but showing a modified construction of the pressure vessel incorporating a fitting of a different type.

FIGS. 4 and 5 also illustrates, in a rather diagrammatic manner, that at least one vane 33, and preferably a plurality of such vanes, is accommodated in the interior 12 of the vessel 10 even after the dissolution of the mandrel. The vanes 33 partition the vessel interior into separate compartments to minimize the extent of liquid sloshing in the interior 12. The vanes 33, which were initially accommodated in the mandrel, have portions 34 lodged in the neck region of the propellant outlet 18 of the vessel 10 and terminates short of contact with the interior of the liner 15 providing a gap or clearance between the vane and the inside surface of the liner to permit liquid transfer between the interior of the vessel 12 and the sump 31.

The liquid is transferred by the surface tensive forces in the fluid and is directed to the sump 31, by controlling the gap or clearance between the edge of the vane 40, and the interior of the liner. The propellant or liquid is thus acquired by the region just upstream of the sump 41. Gas entrainment in the liquid, which is well understood to be detrimental to spacecraft engines, is prevented by the use of a gas arrestor 42 which may be constructed of screen or drilled plate. This gas arrestor 42 separates entrained gas from the liquid as it is drawn through the gas arrestor 42 into the sump 31 and out the outlet tube 32.

While the invention has been illustrated and described as embodied in two pressure vessels, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the contribution to the art and, therefore, such adaptations should and are intended to be comprehended within the meaning and range of equivalence of the claims.

What is claimed as new and desired to be protected by Letters Patent is set forth in the appended claims:

1. A pressure vessel of the type including a hollow main portion and at least one hollow stem region extending outwardly from the hollow main portion along an axis, said hollow stem region bounding a connecting passage communicating with the interior of the main portion, said pressure vessel comprising:

a liner having a first or main portion bounding the interior of the hollow main portion of the vessel and a stem portion extending into and bounding a portion of the hollow stem region for defining less than the entire length of the connecting passage, said main portion and said stem portion of said liner being integral, said stem portion of said liner having an outer end remote from the main portion of said liner;

a filament overwrap overwrapping said main portion of the liner for providing structural integrity thereto;

a fitting member separate from and positioned axially adjacent said outer end of said stem portion of said liner to axially complete the connecting passage and to define, in said hollow stem region, an interface between said firing member and said stem portion outer end; and a non-metallic strengthening body localized at and surrounding said stem portion and a portion of said firing member and anchored to said main portion of said pressure vessel between said main portion of said liner and said filament overwrap;

wherein said strengthening body comprises a body of impregnated filament strengthening material wrapped about said stem portion of said liner and at least a portion of said fitting member so that said stem portion of said liner is stiffened in both a hoop and a longitudinal direction, said filament material also securing said fitting member to said main portion of said liner, and said strengthening body being separate from said filament overwrap and being localized such that said strengthening body extends only in a region substantially adjacent to the stem region of the vessel.

2. The pressure vessel of claim 1, wherein said portion of said fitting member has at least one restraining projection fixed thereto and extending substantially radially outwardly therefrom into said body of impregnated strengthening material such that said impregnated strengthening material engages all exposed surfaces of said restraining projection for restraining said fitting member against at least axial movement relative to said stem portion of said liner.

3. The pressure vessel of claim 2, wherein said restraining projection is an annular circumferential ring projecting outwardly from said axial portion of said fitting member.

4. The pressure vessel of claim 1, wherein said liner is a deposited film liner.

5. The pressure vessel of claim 4, wherein said deposited film liner is of a metallic material.

6. The pressure vessel of claim 5, wherein said metallic material is copper.

7. The pressure vessel of claim 6, wherein said fitting member is of a different material than said film liner.

8. The pressure vessel of claim 7, wherein said different material is a metallic material.

9. The pressure vessel of claim 8, wherein said metallic material of said fitting member is stainless steel.

10. A pressure vessel of the type including a hollow main portion and at least one hollow stem region extending outwardly from the hollow main portion along an axis, said hollow stem region bounding a connecting passage communicating with the interior of the main portion, said pressure vessel comprising:

a liner having a first or main portion bounding the interior of the hollow main portion of the vessel and a stem portion extending into and bounding a portion of the hollow stem region for defining less than the entire length of the connecting passage, said main portion and said stem portion of said liner being integral, said stem portion of said liner having an outer end remote from the main portion of said liner;

a filament overwrap overwrapping said main portion of the liner for providing structural integrity thereto;

a fitting member separate from and positioned axially adjacent said outer end of said stem portion of said liner to axially complete the connecting passage and to define, in said hollow stem region, an interface between said fitting member and said stem portion outer end; and a non-metallic strengthening body localized at and surrounding said stem portion and a portion of said fitting member and anchored to said main portion of said pressure vessel between said main portion of said liner and said filament overwrap;

wherein said strengthening body comprises a body of impregnated filament strengthening material wrapped about said stem portion of said liner and at least a portion of said fitting member so that said stem portion of said liner is stiffened in both a hoop and a longitudinal direction, said filament material also securing said fitting member to said main portion of said liner, and wherein said portion of said fitting member has at least one restraining projection fixed thereto and extending substantially radially outwardly therefrom into said body of impregnated strengthening material such that said impregnated strengthening material engages all exposed surfaces of said restraining projection for restraining said fitting member against at least axial movement relative to said stem portion of said liner.

11. The pressure vessel of claim 10, wherein said restraining projection is an annular circumferential ring projecting outwardly from said axial portion of said fitting member.

* * * * *